US008342322B2

(12) United States Patent
De'Rennaux

(10) Patent No.: US 8,342,322 B2
(45) Date of Patent: Jan. 1, 2013

(54) RAZOR BED

(75) Inventor: Darrell R. De'Rennaux, Steelville, MO (US)

(73) Assignee: Darrell DeRennaux, Steelville, MO (US)

( * ) Notice: Subject to any disclaimer, the term of this patent is extended or adjusted under 35 U.S.C. 154(b) by 0 days.

(21) Appl. No.: 13/112,216

(22) Filed: May 20, 2011

(65) Prior Publication Data

US 2011/0308098 A1 Dec. 22, 2011

Related U.S. Application Data

(60) Provisional application No. 61/356,966, filed on Jun. 21, 2010.

(51) Int. Cl.
*B65D 81/26* (2006.01)
*A45D 27/22* (2006.01)

(52) U.S. Cl. ..... 206/204; 206/228; 206/352

(58) Field of Classification Search ..... 206/204, 206/208, 228, 352, 354; 312/31
See application file for complete search history.

(56) References Cited

U.S. PATENT DOCUMENTS

| | | | | | |
|---|---|---|---|---|---|
| 1,438,305 | A | * | 12/1922 | Guice | 206/208 |
| 1,733,971 | A | * | 10/1929 | Kremer | 206/208 |
| 1,835,408 | A | * | 12/1931 | Kurtz, Jr. | 206/352 |
| 2,235,699 | A | * | 3/1941 | Dickson | 206/354 |
| 2,321,570 | A | * | 6/1943 | Billing | 206/208 |
| 2,349,183 | A | * | 5/1944 | Mahler | 422/7 |
| 2,551,859 | A | * | 5/1951 | Thompson | 206/208 |
| 2,735,542 | A | * | 2/1956 | Shnitzler | 206/228 |
| 2,748,413 | A | * | 6/1956 | Morrow | 15/218 |
| 2,925,905 | A | * | 2/1960 | Metzler et al. | 206/228 |
| 3,759,594 | A | * | 9/1973 | Cobb | 312/31 |
| 5,486,308 | A | * | 1/1996 | Mayeaux | 206/204 |
| 6,415,517 | B1 | * | 7/2002 | Worrick, III | 206/208 |

* cited by examiner

*Primary Examiner* — Bryon Gehman

(57) ABSTRACT

A razor case, also referred to as a razor saver, may keep a razor blade dry and free or any moisture. The razor saver may include an absorbent liner and one or more absorbent desiccant gel packs for removing moisture from the razor blade. The razor saver may extend the life of the razor blade, typically offering the user up to four times the use from a single blade cartridge. The razor saver may save money while also reducing landfill wastes.

8 Claims, 2 Drawing Sheets

RAZOR BED

CROSS-REFERENCE TO RELATED APPLICATIONS

This application claims the benefit of priority to U.S. provisional patent application No. 61/356,966, filed Jun. 21, 2010, the contents of which are herein incorporated by reference.

BACKGROUND OF THE INVENTION

The present invention relates to methods and apparatus for storing a razor and, more particularly, to methods and apparatus for storing a razor that may extend the life of the razor.

Conventional razors are often used, rinsed in water, and stored, typically with water droplets still present on the razor blade. This residual water may damage and dull the razor blade, shortening the useful life of the razor.

One example of a conventional razor storage device uses oil to keep the blade continually wet to extend its life. This system, however, requires the user to wipe oil from the blade prior to use.

As can be seen, there is a need for a razor storage system that may extend the life of a razor.

SUMMARY OF THE INVENTION

In one aspect of the present invention, a razor case comprises a top lid hingedly attached to a case bottom; an absorbent liner disposed on at least a portion of an interior of the top lid and the case bottom; and at least one absorbent desiccant gel pack disposed inside the razor case.

In another aspect of the present invention, a razor case comprises a top lid; a case bottom; a hinge connecting the top lid to the case bottom, the hinge permitting the top lid to close on the case bottom to form a hollow interior; an absorbent liner disposed on at least a portion of an interior of the top lid and the case bottom; at least one absorbent desiccant gel pack disposed inside the razor case; and a spacer disposed in the razor case, the spacer adapted to hold a razor in place inside the razor case.

In a further aspect of the present invention, a method for prolonging the life of a razor comprises storing the razor in a razor case between uses, the razor case including a top lid hingedly attached to a case bottom; an absorbent liner disposed on at least a portion of an interior of the top lid and the case bottom; and at least one absorbent desiccant gel pack disposed inside the razor case.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a razor case, also referred to as a razor saver, that may keep a razor blade dry and free of any moisture. The razor saver may include an absorbent liner and one or more absorbent desiccant gel packs for removing moisture from the razor blade. The razor saver may extend the life of the razor blade, typically offering the user up to four times the use from a single blade cartridge. The razor saver may save money while also reducing landfill wastes.

Figure 1:
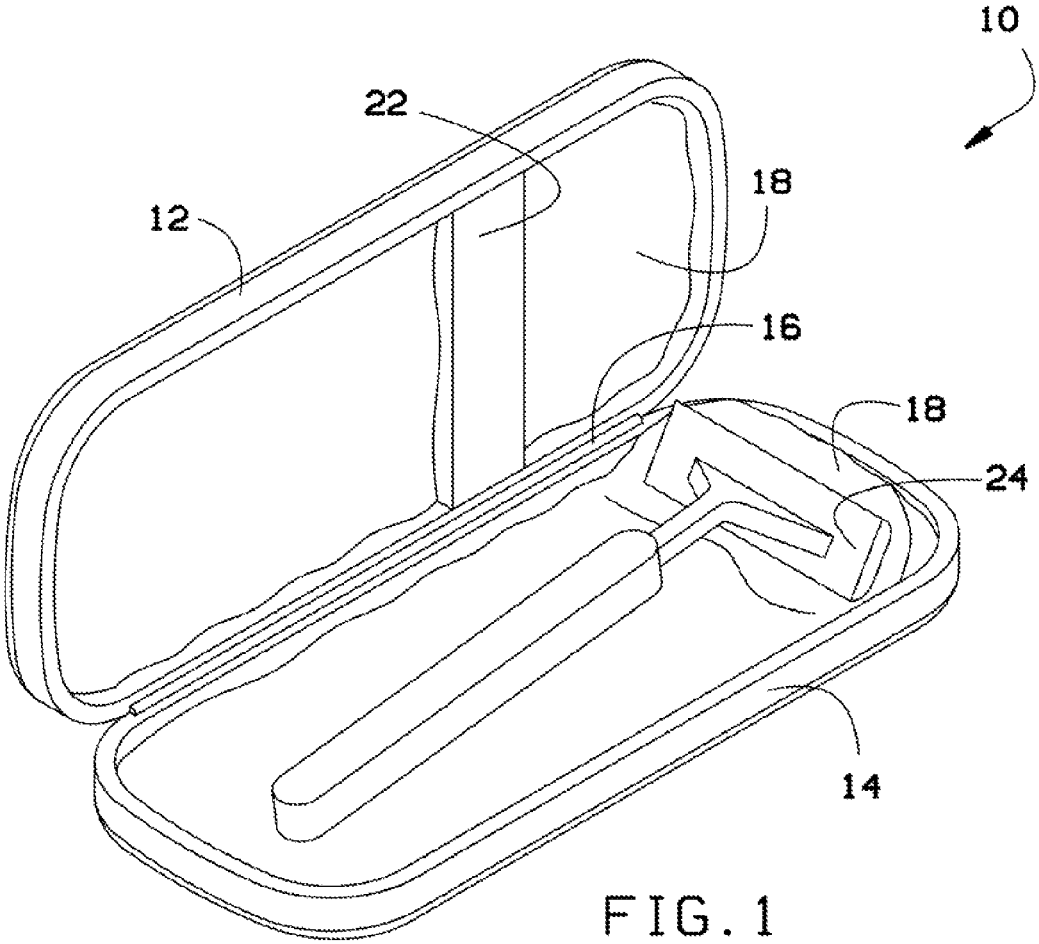
FIG. 1 is a perspective view of a razor saver according to an exemplary embodiment of the present invention.
Figure 2:
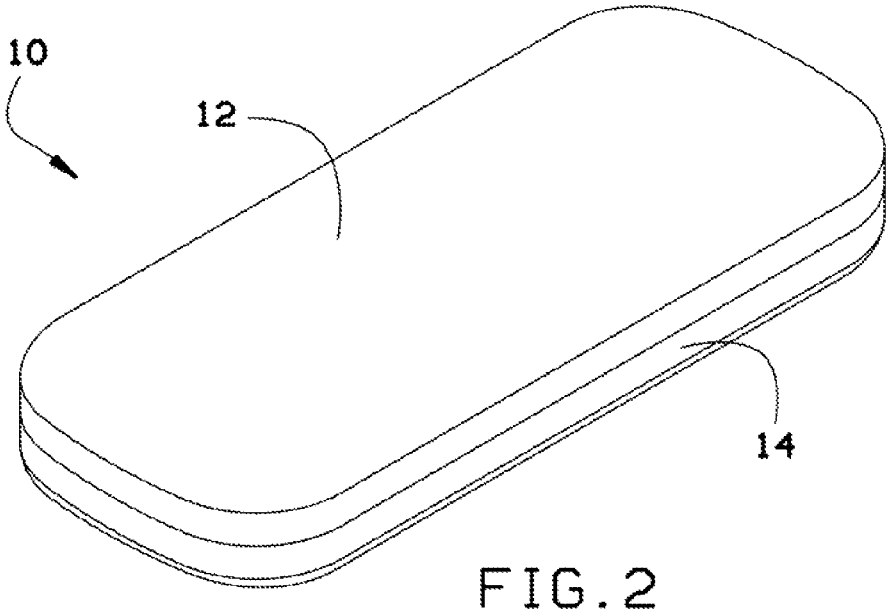
FIG. 2 is a perspective view of the razor saver of FIG. 1 in a closed position.
Figure 3:
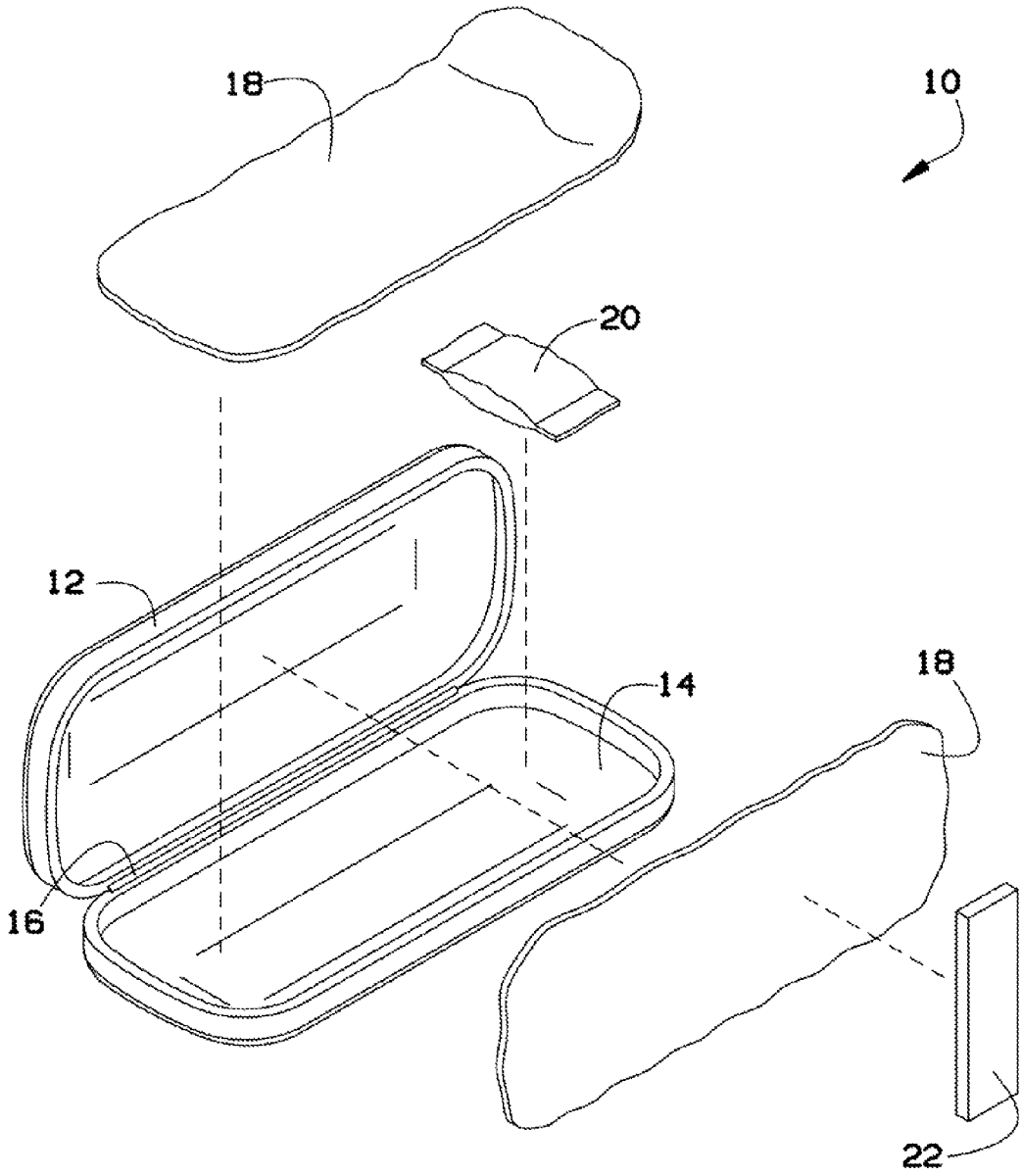
FIG. 3 is an exploded perspective view of the razor saver of FIG. 1.

Referring now to FIGS. 1 through 3, a razor saver 10 may be a hollow case having a top lid 12 and a case bottom 14. A hinge 16 may connect the top lid 12 to the case bottom 14, allowing the hollow case to open and close. In some embodiments, the hinge 16 may extend along one side of the top lid 12 and the case bottom 14. The hinge 16 may be a spring hinge that provides an open position (as shown in FIG. 1) and a closed position (as shown in FIG. 2). The spring hinge may provide a force to keep the top lid 12 pressed against the case bottom 14 when the razor saver 10 is in the closed position.

The razor saver 10 may be lined with an absorbent inner liner 18. In some embodiments, the liner 18 may line the entire interior surface of the razor saver 10. In other embodiments the liner 18 may line a portion of one or more of the interior surfaces of the top lid 12 and the case bottom 14. The liner 18 may be made from an absorbent material, such as cotton, chamois, terry cloth, or the like.

One or more absorbent desiccant gel packs 20 may be disposed inside the razor saver 10. In some embodiments, the desiccant gel packs 20 may be disposed between the liner 18 and the top lid 12 and/or the case bottom 14. In some embodiments, as shown in FIG. 3, the desiccant gel pack 20 may be disposed under the liner 18 at one end of the case bottom 14. The desiccant gel pack 20 may be disposed under the liner 18 at a location where blades of a razor 24 disposed in the razor saver 10 would be adjacent to the desiccant gel pack 20. From one to several desiccant gel packs 20 may be disposed inside the razor saver 10. In some embodiments, the desiccant gel packs 20 may be reusable. For example, a user may place the used desiccant gel packs 20 in a warm oven to regenerate the water absorbing properties of the desiccant gel packs 20. The desiccant gel pack 20 may be made of, for example, silica gel.

A spacer 22 may be disposed on the liner 18 disposed on the top lid 12 of the razor saver 10. The spacer 22 may be made of a resilient material, such as foam, rubber, and the like. The spacer 22 may be adapted to provide a holding force onto the razor 24 when the razor saver 10 is closed (as shown in FIG. 2). The spacer 22 may not only contain the razor 24 in one place inside the razor saver 10, but may also help push the blade of the razor 24 into the liner 18, where a wicking action may help pull water from the blade of the razor 24 into the liner 18. In some embodiments, a strap (not shown) may be disposed in the case bottom 14. The strap may help secure the razor 24 inside the razor saver 10.

While the present invention describes extending the life of a razor with the razor saver 10, other bladed tools that may suffer water damage may benefit from the present invention. For example, medical tools, cooking tools and the like may be used with the case as herein described.

It should be understood, of course, that the foregoing relates to exemplary embodiments of the invention and that modifications may be made without departing from the spirit and scope of the invention as set forth in the following claims.

What is claimed is:

1. A razor case comprising:

a top lid hingedly attached to a case bottom;

an absorbent liner disposed on at least a portion of an interior of the top lid and the case bottom; and at least one absorbent reusable desiccant gel pack disposed inside the razor case.

2. The razor case of claim 1, wherein the absorbent liner is disposed on both the top lid and the case bottom, wherein at least one of the at least one absorbent desiccant gel pack is disposed under the liner at one end of the case bottom, at a location where the blades of a razor disposed in the razor case would be adjacent to the at least one of the at least one absorbent desiccant gel pack.

3. The razor case of claim 1, further comprising a spacer disposed in the razor case, the spacer adapted to hold a razor in place inside the razor case.

4. The razor case of claim 3, wherein the spacer is made of foam.

5. The razor case of claim 1, further comprising a hinge connecting the top lid to the case bottom, wherein the hinge provides a force to hold the top lid to the case bottom in a closed position.

6. A razor case comprising:

a top lid;

a case bottom;

a hinge connecting the top lid to the case bottom, the hinge permitting the top lid to close on the case bottom to form a hollow interior;

an absorbent liner disposed on at least a portion of an interior of the top lid and the case bottom;

at least one absorbent pre-warmed desiccant gel pack disposed inside the razor case; and a spacer disposed in the razor case, the spacer adapted to hold a razor in place inside the razor case, wherein at least one of the at least one absorbent desiccant gel pack is disposed under the liner at one end of the case bottom, at a location where the blades of a razor disposed in the razor case would be adjacent to the at least one of the at least one absorbent desiccant gel pack.

7. A method for prolonging the life of a razor, comprising:

storing the razor in a razor case between uses, the razor case including a top lid hingedly attached to a case bottom;

strapping the razor into place in the razor case;

disposing an absorbent liner on at least a portion of an interior of the top lid and the case bottom; and disposing at least one absorbent desiccant gel pack inside the razor case, wherein at least one of the at least one absorbent desiccant gel pack is disposed under the liner at one end of the case bottom, at a location where the blades of the razor are adjacent to the at least one of the at least one absorbent desiccant gel pack.

8. The method of claim 7, further comprising securing the razor in the case with a resilient spacer disposed in the razor case.

* * * * *